US008622701B1

(12) United States Patent
Liang

(10) Patent No.: US 8,622,701 B1
(45) Date of Patent: Jan. 7, 2014

(54) TURBINE BLADE PLATFORM WITH IMPINGEMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 488 days.

(21) Appl. No.: 13/091,328

(22) Filed: Apr. 21, 2011

(51) Int. Cl.
*F01D 5/18* (2006.01)
*F01D 5/08* (2006.01)

(52) U.S. Cl.
USPC ..... 416/95; 416/96 R; 416/96 A; 416/219 R; 416/248; 415/115; 415/116

(58) Field of Classification Search
USPC ..... 416/95, 96 R, 96 A, 219 R, 248; 415/115, 415/116
See application file for complete search history.

(56) References Cited

U.S. PATENT DOCUMENTS

| | | | | |
|---|---|---|---|---|
| 2,931,623 | A * | 4/1960 | Hyde | 416/92 |
| 3,804,551 | A * | 4/1974 | Moore | 416/97 R |
| 5,281,097 | A * | 1/1994 | Wilson et al. | 416/193 A |
| 5,957,660 | A * | 9/1999 | Evans et al. | 416/97 R |
| 8,087,871 | B2 * | 1/2012 | Black | 415/1 |
| 2009/0060712 | A1 * | 3/2009 | De Cardenas | 415/115 |

* cited by examiner

*Primary Examiner* — Igor Kershteyn
(74) *Attorney, Agent, or Firm* — John Ryznic

(57) ABSTRACT

A turbine rotor disk with rotor blades secured within slots, where the rotor disk includes a radial extension that occupies a space where a dead rim cavity would be formed, and in which the radial extension includes a cooling air chamber with impingement cooling air holes directed to discharge impingement cooling air to a backside surface of the platforms of the blades.

1 Claim, 5 Drawing Sheets

TURBINE BLADE PLATFORM WITH IMPINGEMENT COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine blade with platform cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Prior art turbine rotor blades provide cooling for the platform using several methods. FIGS. 1 and 2 show film cooling holes 13 that open onto the hot surface of the platform 11 on a pressure side of the airfoil 12 supplied with cooling air from the dead rim cavity located below the platform. Film cooling holes supplied from the dead rim cavity requires a higher dead rim cavity pressure than the platform external hot gas pressure. The higher pressure in the dead rim cavity induces a high leakage flow around the blade attachment region and therefore causes engine performance to decrease.

FIGS. 3 and 4 shows another method for cooling blade platforms that uses cooling channels 14 with a long length to diameter ratio to provide convection cooling of the platform hot surface. These long cooling channels are drilled into the platform from the edge side and into the airfoil cooling core. Drilling the convection cooling holes produces unacceptable stress levels and yields a low blade life. This shortened blade life is primarily due to the large mass at the front and back end of the blade attachment which constrains the blade platform edge expansion. The cooling channels are oriented transverse to the primary direction of the stress field so that high stress concentrations associated with the cooling channels are formed at the entrance and exit locations.

BRIEF SUMMARY OF THE INVENTION

A turbine rotor disk with rotor blades secured within slots of the rotor disk, and the rotor disk includes a radial extension that occupies a space where a dead rim cavity would be formed. The radial extension includes a cooling air chamber with impingement cooling holes that are directed to produce impingement cooling to the blade platforms.

The cooling air chamber is supplied from a cooling air passage with both the chamber and the passage being formed on one side of the rotor disk and enclosed by a cover plate secured to that side of the rotor disk.

DETAILED DESCRIPTION OF THE INVENTION

Figure 1:
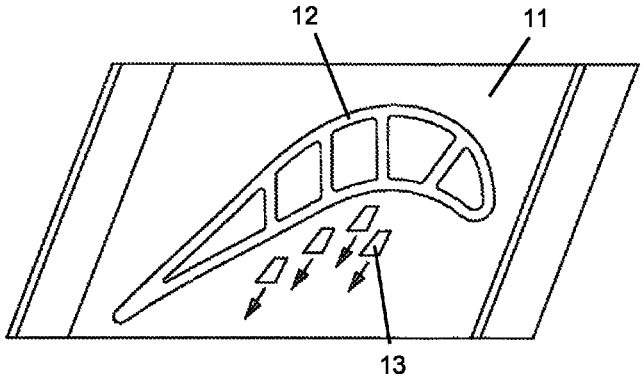
FIG 1 prior art
FIGS. 1 and 2 show a prior art turbine rotor blade with platform cooling that uses film cooling holes that open onto the platform surface.
Figure 2:
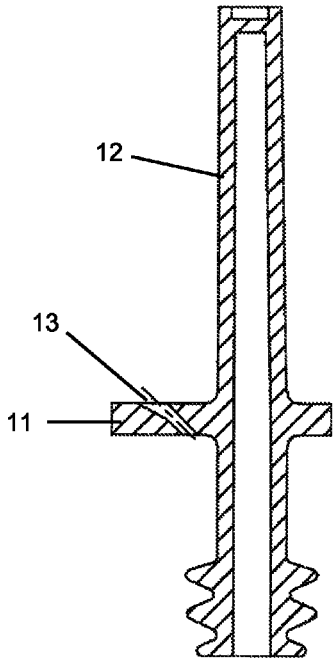
FIG 2 prior art
Figure 3:
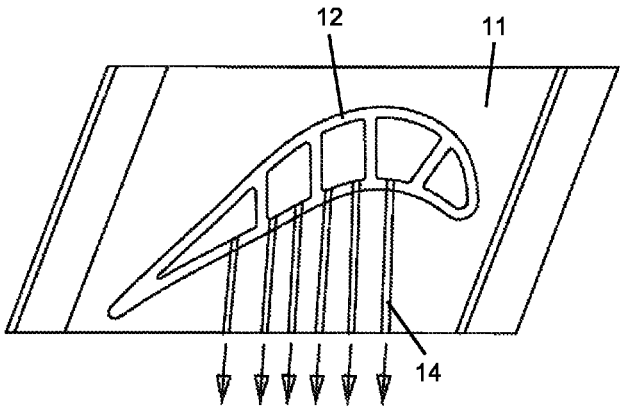
FIG 3 prior art
FIGS. 3 and 4 shows a prior art turbine rotor blade with platform cooling produced using long convection cooling holes.
Figure 4:
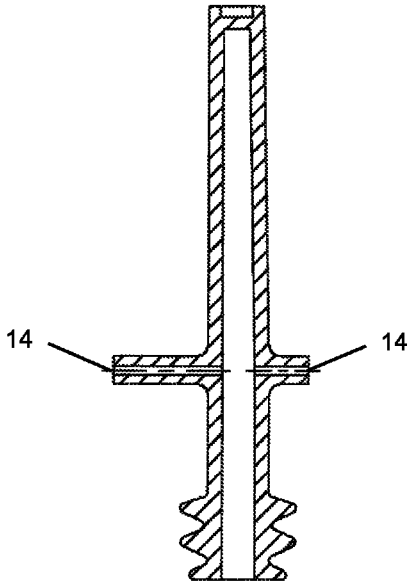
FIG 4 prior art
Figure 5:
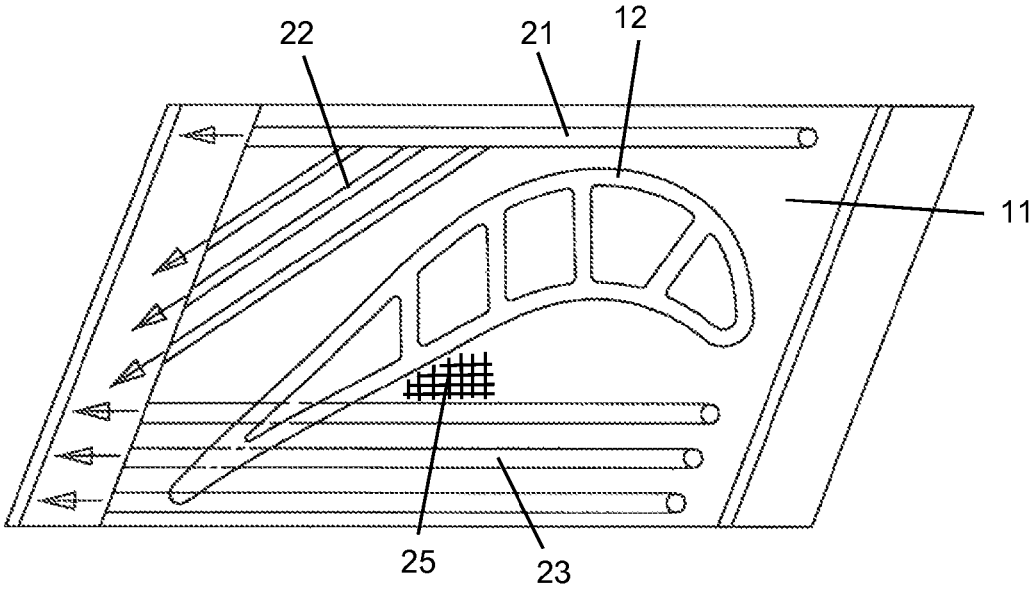
FIG. 5 shows a hot spot identified by the applicant in the prior art blade platform.

FIG. 5 shows a prior art turbine blade with platform cooling produced using the long length to diameter ratio cooling channels. The suction side includes a long channel 21 that branches off into smaller channels 22 to provide cooling for the suction side surface of the platform. The pressure side includes several long channels 23 each supplied from an inlet connected to the dead rim cavity. The applicant has identified a hot spot 25 that results in the cooling channels of the prior art FIG. 5 blade. The straight cooling channels in the FIG. 5 blade are not able to provide cooling for this hot spot area 25.

Figure 6:
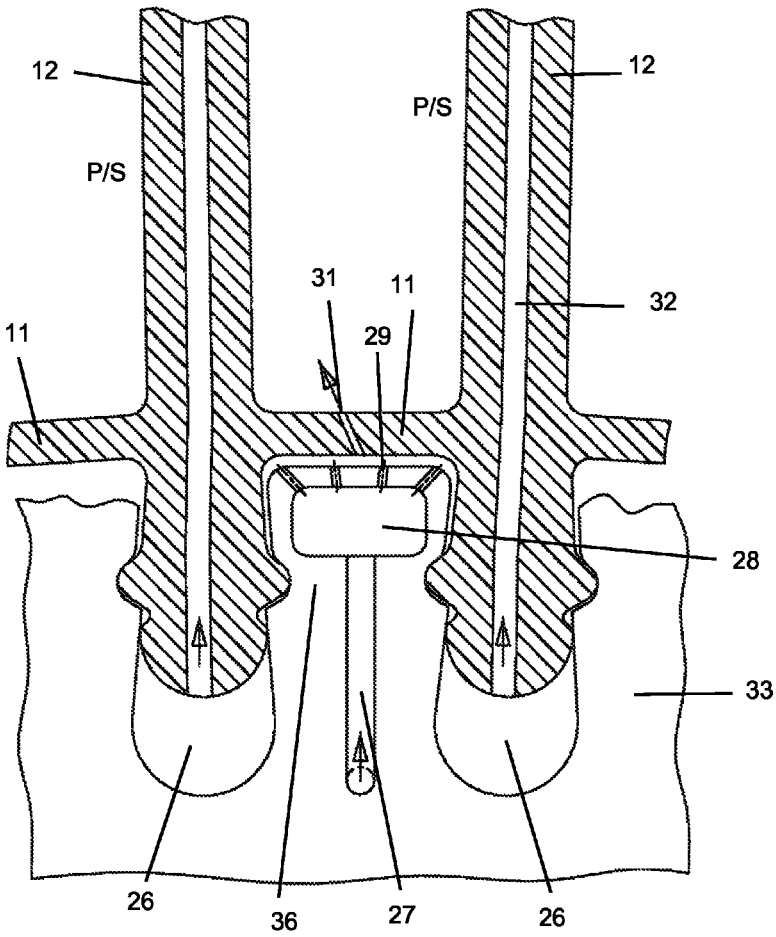
FIG. 6 shows a cross section front view of the rotor disk and platform cooling circuit of the present invention.

To provide better cooling for the blade platform and to eliminate the hot spot identified by the applicant, the blade rotor disk is formed with an extension that forms an impingement cooling chamber that discharges impingement cooling air to the backside surface of the platform. FIG. 6 shows this design and includes a turbine rotor disk 33 formed with a live rim cavity 26 for each turbine rotor blade 12. The rotor disk 33 is formed with a radial extension 36 that includes a cooling air chamber 28 formed underneath the platforms 11 of the blades 12. The radial extension 36 will occupy the previous formed dead rim cavity of the rotor disk design. Impingement cooling holes 29 connect to the cooling air chamber 28 and discharge impingement cooling air to the backside of the platforms 11. A cooling air supply hole 27 supplies cooling air to the cooling air chamber 28.

Figure 7:
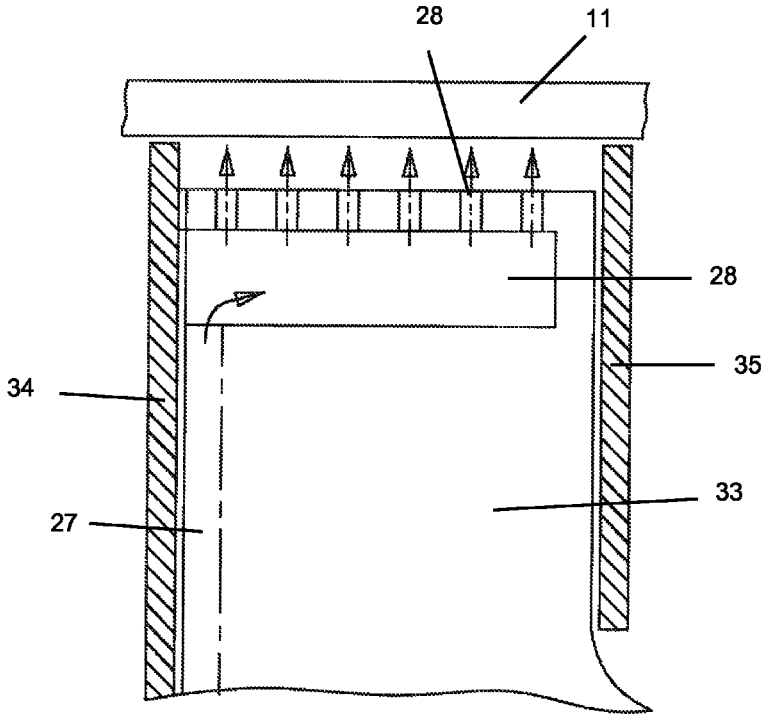
FIG. 7 shows a cross section side view of the rotor disk and platform cooling circuit of the present invention.

FIG. 7 shows a side view of the platform cooling circuit of the present invention. The rotor disk 33 includes the radial extension with the cooling air chamber 28 that opens onto one of the two sides of the rotor disk. In this embodiment, the cooling air chamber 28 opens onto the front side and is enclosed by a front cover plate 34. The cooling air supply channel 27 is formed on the same side of the rotor disk and is also enclosed by the cover plate 34. An aft cover plate 35 is secured onto the aft side of the rotor disk 33. the arrangement of impingement cooling holes 28 connect to the cooling air chamber 28 and direct impingement cooling air to the backside of the platforms 11.

In operation, cooling air supplied to the turbine rotor disk will flow into the live rim cavities 26 and through the blade cooling channel 32 to provide cooling for the interior of the blade 12. Cooling air is also supplied to the cooling air supply channel 27 and flows into the cooling air chamber 28, where the cooling air is then discharged through the impingement holes 29 to provide backside impingement cooling to various areas of the two adjacent platforms 11. The spent impingement cooling air then flows through a blade mate face gap 31 forms between adjacent platforms 11 to be joined with the hot gas stream passing through the blades. This produces purge air to prevent hot gas ingestion below the platforms 11.

As a result of the platform cooling circuit of the present invention, the hot spot formed on the prior art blade platform is eliminated. Also, both the blade platform and the rotor disk are cooled using the same cooling air which doubles the use of the cooling air. Because the rotor disk is also cooled, the rotor disk can be formed from a lower cost material than in the prior art.

I claim the following:

1. A turbine rotor disk for a gas turbine engine comprising:

a rotor disk with a plurality of slots each to receive a turbine rotor blade;

a radial extension formed on the rotor disk between adjacent slots;

a cooling air chamber formed within the radial extension and connected to a cooling air supply channel;

a plurality of impingement cooling holes connected to the cooling air chamber;

the turbine rotor blade secured within the slot of the rotor disk;

the rotor blade having a platform extending over the impingement cooling holes of the cooling air chamber;

the impingement cooling holes are directed to discharge impingement cooling air to a backside surface of the platform;

the cooling air chamber and the cooling air supply channel are formed on one side of the rotor disk; and, a cover plate is secured to the side of the rotor disk and encloses both the cooling air chamber and the cooling air supply channel.

* * * * *